US005326204A

United States Patent [19]

Carlson et al.

[11] Patent Number: 5,326,204

[45] Date of Patent: Jul. 5, 1994

[54] DUNNAGE SUPPORT BAR

[75] Inventors: Bret M. Carlson, Grosse Pointe Farms; Stephen M. Tobias, Cottrellville, both of Mich.

[73] Assignee: Wolpac, Inc., Roseville, Mich.

[21] Appl. No.: 979,669

[22] Filed: Nov. 20, 1992

[51] Int. Cl.[5] ..... B60P 7/15

[52] U.S. Cl. ..... 410/143; 211/183; 52/710; 410/144

[58] Field of Search ..... 410/32, 33, 143-152; 428/586, 595, 603; 211/183, 193; 248/225.1; 52/710, 730.3, 730.4, 730.6, 731.8, 732.1, 732.3, 738

[56] References Cited

U.S. PATENT DOCUMENTS

| | | | |
|---|---|---|---|
| 931,164 | 8/1909 | Vining . | |
| 2,791,017 | 5/1957 | Mulka . | |
| 3,040,905 | 6/1962 | Gingher et al. | 211/183 X |
| 3,332,197 | 7/1967 | Hinkle . | |
| 3,587,867 | 6/1971 | Fenwick | 211/183 |
| 3,999,875 | 12/1976 | Simon . | |
| 4,238,550 | 12/1980 | Burgess et al. . | |
| 4,385,475 | 5/1983 | Nakamura | 52/730.4 X |
| 4,553,888 | 11/1985 | Crissy et al. | 410/152 X |
| 4,683,097 | 7/1987 | Hand et al. . | |
| 4,720,222 | 1/1988 | Nagy et al. | 410/151 |
| 4,756,774 | 7/1988 | Fox . | |
| 4,919,277 | 4/1990 | Jeruzal . | |
| 5,012,938 | 5/1991 | King . | |
| 5,037,256 | 8/1991 | Schroeder . | |

OTHER PUBLICATIONS

Various Drawings of Dunnage Bars (8 sheets).

*Primary Examiner*—Michael S. Huppert
*Assistant Examiner*—Stephen Gordon
*Attorney, Agent, or Firm*—Harness, Dickey & Pierce

[57] ABSTRACT

A dunnage support bar for supporting and retaining dunnage is formed with a number of longitudinal extending semicircular indented ribs for strengthening the bar and resisting bending. The dunnage bar has a T-shaped channel for slidingly receiving the dunnage, which supports an article to be transported. The bar is formed of at least two members, one folded within another, so as to affix the members together and prevent relative motion.

15 Claims, 2 Drawing Sheets

DUNNAGE SUPPORT BAR

BACKGROUND OF THE INVENTION

1. Technical Field

The present invention relates generally to material handling systems, and more particularly to a dunnage bar for use in a dunnage support structure.

2. Discussion

Various articles must be transported in almost every industry. For example, in the automobile industry, parts and components must be shipped from vendors to the automobile manufacturers. Many larger automotive components and subassemblies are shipped in custom designed rack assemblies, or dunnage support structures. These dunnage support structures include a horizontal metal base frame, two vertical end frames, and pairs of vertical support racks located at opposite ends of the horizontal frame. The vertical racks retain dunnage support bars which extend horizontally between a pair of the racks. The dunnage support bars are generally constructed of metal and may have a T-shaped channel for receiving an appropriately formed portion on a dunnage detail or member. The dunnage member slides onto a dunnage support bar and is locked in place longitudinally by dunnage stops which may be bolted or otherwise removably secured to the dunnage bar. The dunnage members are generally plastic or rubber and are formed to uphold and cushion the part or component from potentially damaging impacts while being transported.

The elements of the dunnage support structure are generally of a standard configuration, while the dunnage members are specifically designed for each particular type of part or component transported. The entire dunnage support structure is generally constructed to be disassembled and collapse after the parts have been shipped, in order to return the dunnage support structure to the vendor for use in a subsequent shipment.

Dunnage bars have generally been constructed of extruded aluminum, although steel has also been used. However, aluminum dunnage bars are difficult and costly to manufacture. In view of the fact that aluminum is not only relatively costly, but also readily recyclable, many aluminum dunnage bars are subject to theft. On the other hand, steel dunnage bars are generally heavy and are susceptible to corrosion. The steel bars are also generally not sufficiently flexible, and yield to permanent deformation under relatively light loads.

Accordingly, it is desirable to provide a dunnage bar which is strong, lightweight, abrasion and corrosion resistant, and less susceptible to theft. Furthermore, it is desirable to provide a dunnage bar which is resilient and can accept a wide variety of loads and impacts without permanent deformation. Other factors which affect the design of such a desirable dunnage support bar are size, cost, ease of manufacture, and protection for the articles to be shipped.

SUMMARY OF THE INVENTION

The present invention provides a dunnage support bar having a novel configuration for supporting and retaining dunnage. It has a plurality of longitudinal ribs to improve its strength and resist bending. The bar is generally formed having a hollow rectangular cross-section having two side walls and a first and second base. The bar is constructed of at least two members, at least one member being surrounded and held in place by retaining flanges and retaining lips formed on another member, without the need for adhesive or other like means to affix the members together in a stationary relationship. One or more portions of a member are bent and crimped to form the retaining flanges and retaining lips which enclose and grip a tab formed on another member. The members of the dunnage bar cooperate to form at least one T-shaped channel for slidingly accepting dunnage and dunnage stops. These and other various advantages and features of the novel dunnage support bar will become apparent from the following description and claims, in conjunction with the appended drawings:

BRIEF DESCRIPTION OF THE DRAWINGS

FIG. 6 is an enlarged perspective view showing a dunnage support bar latch assembly for use in conjunction with the present invention.

DETAILED DESCRIPTION OF THE PREFERRED EMBODIMENT

The following description of the preferred embodiments is merely exemplary in nature, and is in no way intended to limit the invention, or its application or uses.

Figure 5:
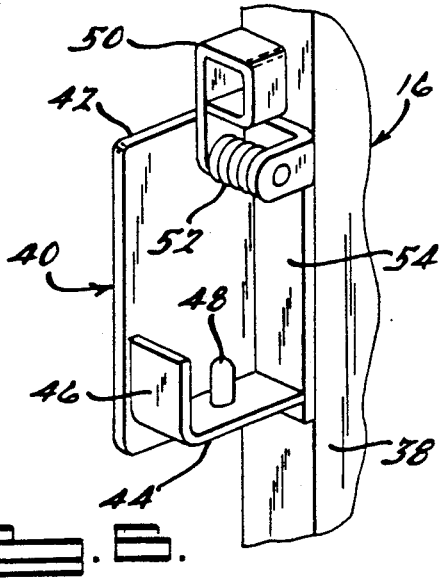
FIG. 5 is a perspective view of a dunnage support structure according to the present invention.
Figure 5:
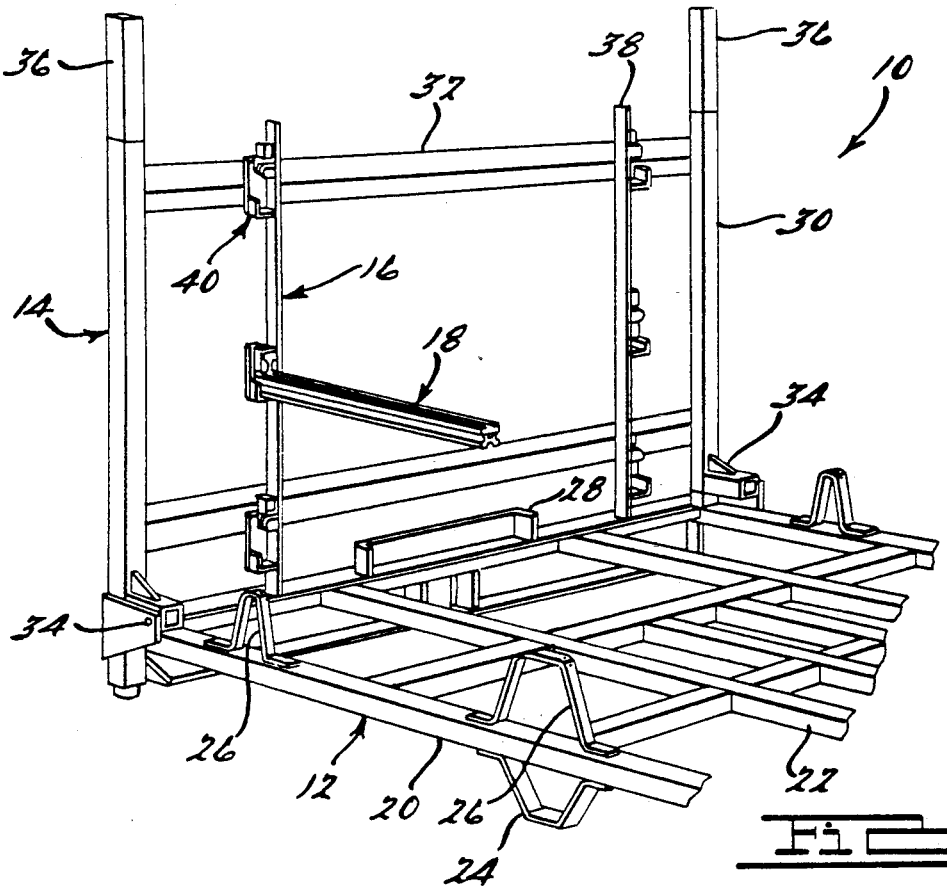

With reference to the drawings, a dunnage support structure 10 as shown in FIG. 5 is constructed of a horizontal base 12, vertical end frames 14, vertical dunnage bar latching racks 16, and a number of dunnage support bars 18 in accordance with the present invention. Horizontal frame 12 is constructed of welded steel tubes 20, including reinforcing members 22, support feet 24 for supporting frame 12 off a support surface and aiding in loading and unloading the dunnage support structure on a forklift, and upper support members 26 for supporting end frames 14 when frames 14 are folded down parallel with horizontal frame 12. Frame 12 is also preferably equipped with dunnage bar storage pockets 28, in which the ends of dunnage bars 18 may be placed. When bars 18 are placed in pockets 28, end frames 14 may be folded down to hold bars 18 in place.

End frame 14 is constructed of vertical and horizontal supports, 30 and 32, and is preferably mounted to frame 12 by means of hinges 34. The available height of dunnage support structure 10 may be extended by vertical extension posts 36. Vertical dunnage bar latching racks 16 are preferably constructed of vertical members 38 and a releasable latch assembly 40. Latch assembly 40 is shown in greater detail in FIG. 6, and preferably comprises a backing plate 42, latch base 44, side wall 46, centering post 48, and latch member 50 which is biased towards a closed horizontal position by a spring 52. Latch member 50 is shown in FIG. 6 in an open position. Latch assembly 40 also has a mounting plate 54 which is affixed in a stationary manner to vertical member 38 by a fastening means (not shown). Dunnage support bar 18 is inserted into position within latch assembly 40 and latch member 50 is allowed to spring into the closed position and releasably retain dunnage bar 18 in position. Centering post 48 fits within an indented rib formed on dunnage bar 18 and serves to further retain bar 18 in its operative position.

Figure 1:
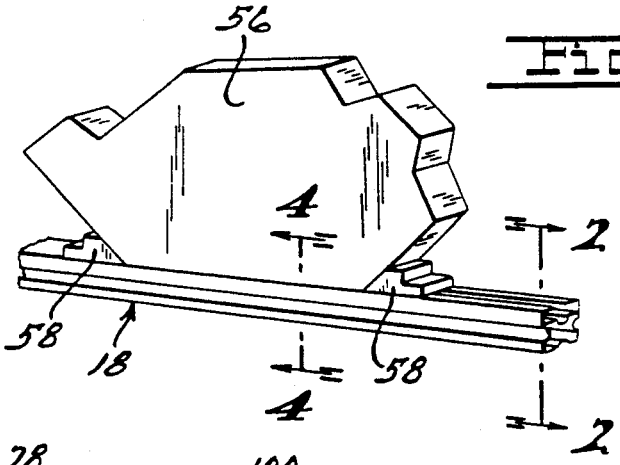
FIG. 1 is a perspective view of a dunnage support bar assembled with dunnage in accordance with the principles of the present invention.
Figure 2:
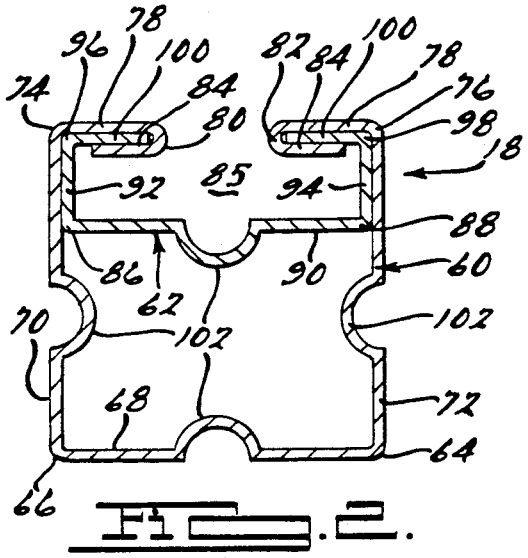
FIG. 2 is a cross-sectional view along line 2—2 of FIG. 1, showing the dunnage support bar of the present invention.
Figure 4:
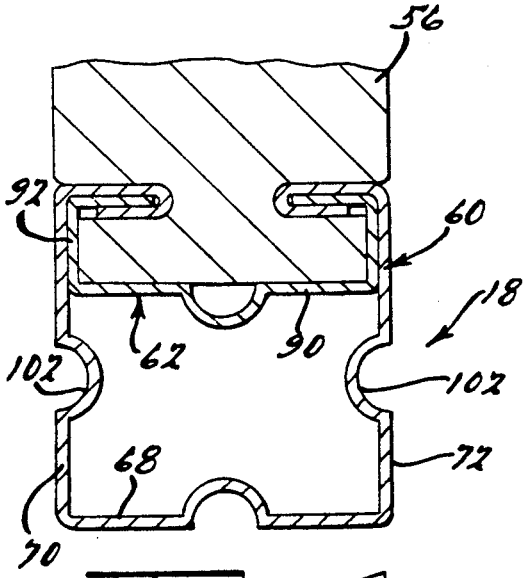
FIG. 4 is a cross-sectional view along line 4—4 of FIG. 1, showing a dunnage support bar and attached dunnage according to the present invention.

The dunnage support bar 18 of the present invention is shown in FIG. 1, having dunnage 56 and dunnage stops 58 assembled in place. Dunnage support bar 18, shown in greater detail in FIGS. 2 and 4, is constructed of a first member 60 and a second member 62. The elements of dunnage bar 18 will be discussed with reference to three mutually orthogonal axes: longitudinal, lateral, and transverse. First member 60 extends in a longitudinal direction between two latch assemblies 40 located at opposing ends of base 12. First member 60 has first and second longitudinal bends 64 and 66 defining a laterally extending base 68 and two side walls 70 and 72. First member 60 further has third and fourth longitudinal bends 74 and 76 defining two retaining flanges 78 each extending laterally inwardly from the third and fourth bends 74 and 76. First member 60 is also formed with fifth and sixth longitudinal bends 80 and 82 defining two retaining lips 84 each extending laterally outwardly from fifth and sixth bends 80 and 82 and which are located below retaining flanges 78.

Second member 62 is formed with first and second longitudinal bends 86 and 88 defining a base 90 and side walls 92 and 94. Second member 62 further has third and fourth longitudinal bends 96 and 98 defining two laterally inwardly extending tabs 100. Second member 62 is assembled within first member 60, such that tabs 100 are held in place within retaining channels defined by retaining flanges 78 and retaining lips 84. Retaining flanges 78 and retaining lips 84 are preferably crimped and therefore frictionally grip tabs 100 to prevent relative motion between first and second members 60 and 62. No adhesive or other fastening means is necessary to affix first and second members 60 and 62 together, although an adhesive or other fastening means may be used. The dunnage bar 18 of the present invention thus provides a hollow and lightweight, yet strong support bar having a T-shaped channel 85 for slidingly accepting dunnage 56 and dunnage stops 58.

Dunnage support bar 18 is shown in FIG. 4 with dunnage 56 assembled in place within the T-shaped channel 85. Such dunnage 56 may be inserted along channel 85 to any desired position. Dunnage stops 58 are then used to removably fix dunnage 56 in its desired location by use of known fastening means to attach the dunnage stops.

In order to increase the strength of dunnage support bar 18 and resist bending or deformably yielding under a predetermined loading, at least one longitudinally extending preferably semicircular rib 102 is provided in at least one of side walls 70 or 72. Ribs 102 are indentations which provide for a simple and economical method for strengthening bar 18. In the embodiment shown in FIGS. 2 and 4, ribs 102 are preferably inwardly formed in bases 68 and 90, and side walls 70 and 72. Ribs 102 may be formed having any appropriate cross-section, such as triangular, or may project outward from side walls 70 and 72 or bases 68 and 90. Dunnage bar 18 may also be formed such that any of side walls 70 and 72 or bases 68 and 90 may be formed with more than one rib 102 or having no rib 102.

Dunnage support bar 18 is preferably made from heat treated spring steel in sheet form and having a relatively high nickel content, which is more economical than other materials such as aluminum. Spring steel is preferable for its relatively high modulus of elasticity, which allows dunnage bar 18 to support a greater load without assuming a permanent deformation. Dunnage support bar 18 is preferably heat treated for additional strength by a method such as that disclosed in U.S. Pat. No. 4,756,774 to Patrick L. Fox and entitled "Shallow Case Hardening and Corrosion Inhibition Process". Dunnage support bar 18 may be protected by a corrosion and abrasion resistant coating, such as plastic or by galvanizing. Accordingly, dunnage bar 18 is preferably heat treated after assembly by heating it in a furnace for a period of time, and then dipping the hot bar 18 into a polymer bath. The polymer bath then cools and provides a suitable coating which resists corrosion.

Figure 3:
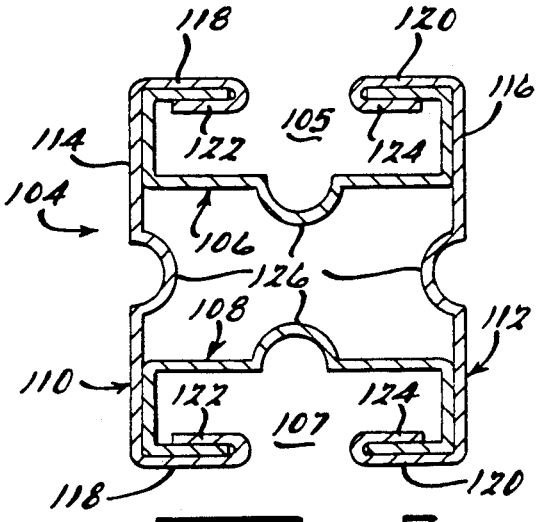
FIG. 3 is a cross-sectional view of an alternative embodiment of a dunnage support bar of the present invention.

An alternative embodiment of the present invention is shown in FIG. 3. Bar 104 is constructed to define both an upper and lower T-shaped channel 105 and 107 for slidingly accepting dunnage 56 and dunnage stops 58. Bar 104 has first and second members 106 and 108, both formed substantially similar to second member 62 of bar 18. However, bar 104 has third and fourth members 110 and 112 each being formed with a side wall 114 and 116, retaining flanges 118 and 120, and retaining lips 122 and 124. Members 106 and 108 are assembled within members 110 and 112 such that flanges 118, 120, and retaining lips 122 and 124 hold members 106 and 108 fixedly in place, thereby forming a rectangular bar 104 having the desired upper and lower T-shaped channels. Moreover, members 106, 108, 110 and 112 are preferably formed with longitudinal extending semicircular indented ribs 126 similar to ribs 102 to strengthen bar 104 and resist bending.

Figure 7:
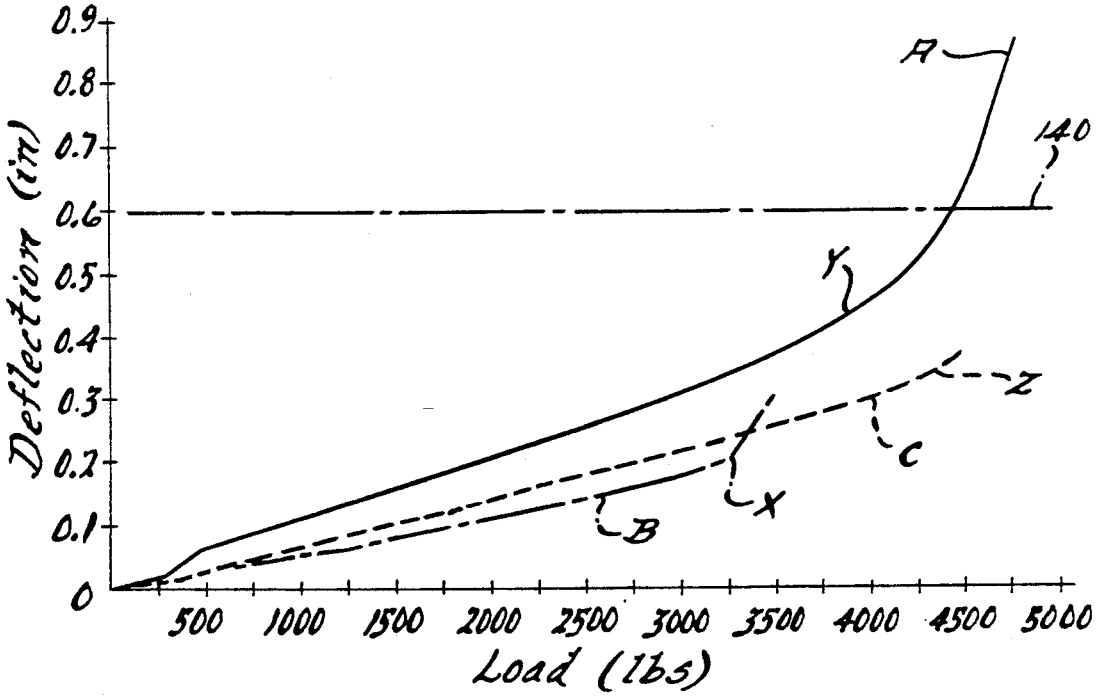
FIG. 7 is a chart illustrating exemplary test data of deflection with respect to load for various dunnage support bars.

A dunnage support bar according to the principles of the present invention was tested, along with another dunnage bar configuration made from steel and an extruded aluminum dunnage bar, to determine the various amounts of deflection each bar would undergo under different loads. More particularly, the load was steadily increased on each bar until the point of failure. The results of this test are graphically represented in FIG. 7. Line 140 defines the ultimate failure point at 0.6 inches of deflection for a dunnage support bar 36 inches long. The critical point for any dunnage support bar is that load at which the deflection graph becomes non-linear and curves upward. At this point, the bar begins to permanently deform. Line A of FIG. 7 represents the graph of deflection for various loads for an extruded aluminum dunnage support bar having a wall thickness of 0.190 inches. Line B represents the graph for another steel dunnage support bar different from the present invention, having a wall thickness of 0.110 inches. Line C illustrates the results for a dunnage support bar 18 according to the present invention, having a wall thickness of 0.060 inches. As FIG. 7 shows, a steel dunnage support bar begins to permanently deflect or deform under a load of approximately 3,250 pounds, represented by point X; the aluminum dunnage bar begins to permanently deflect under a load of approximately 4,000 pounds, represented by point Y; and a dunnage support bar 18 according to the present invention began to permanently deflect under a load of approximately 4,250 pounds, represented by point Z. FIG. 7 thus illustrates the increased strength and resiliency of the dunnage bar 18 of the present invention in comparison with conventional extruded aluminum and steel dunnage bars, even though the dunnage bar 18 of the present invention was constructed having thinner walls.

It should be understood that an unlimited number of configurations of the present invention can be realized. The foregoing discussion discloses and describes merely exemplary embodiments of the present invention. One skilled in the art will readily recognize from the discussion and from the accompanying drawings and claims, that various changes, modifications and variations can be made without departing from the spirit and scope of the invention, as defined in the following claims.

What is claimed is:

1. A dunnage support bar for supporting and retaining dunnage, comprising:

a first member extending in a longitudinal direction and having first and second longitudinal bends defining a first base extending in a lateral direction orthogonal to said longitudinal direction and two first side walls each extending from said first base in a transverse direction orthogonal to said longitudinal and lateral directions, said first member having third and fourth longitudinal bends defining two retaining flanges each extending laterally inwardly from said first side walls, said first member having fifth and sixth longitudinal bends defining two retaining lips each extending laterally outwardly from said fifth and sixth bends and being located between said retaining flanges and said first base, at least one of said first side walls having a longitudinally extending rib therein for strengthening said first member and resisting bending thereof; and a second longitudinally extending member having first and second longitudinal bends defining a second base and two second side walls each extending from said second base in said transverse direction, said second member having third and fourth longitudinal bends defining two tabs extending laterally inwardly from said second side walls;

said first and second members being assembled such that said tabs are each gripped by and fit within a retaining channel defined by said retaining flanges and retaining lips, whereby said first member fixedly retains said second member in place relative to said first member, thereby defining a T-shaped channel within said dunnage support bar for receiving said dunnage.

2. The dunnage support bar as set forth in claim 1, wherein said bar is formed of spring steel.

3. The dunnage support bar as set forth in claim 2, wherein said steel is heat treated.

4. The dunnage support bar as set forth in claim 1, wherein said bar is formed of a metal having a coating for resisting corrosion.

5. The dunnage support bar as set forth in claim 1, wherein said rib is formed as an inwardly extending indentation.

6. The dunnage support bar as set forth in claim 1, wherein at least one of said bases is formed with a longitudinally extending rib.

7. A dunnage support bar for supporting and retaining dunnage, comprising:

a first member extending in a longitudinal direction being orthogonal to a lateral direction and to a transverse direction, said first member having first and second longitudinal bends defining a first member side wall extending in said transverse direction and two first member retaining flanges each extending laterally inwardly from said first member side wall, said first member having third and fourth longitudinal bends defining two first member retaining lips each extending laterally outwardly from an inward end of each of said first member retaining flanges, each of said first member retaining lips being located between said first member retaining flanges;

a second member extending in said longitudinal direction, said second member having first and second longitudinal bends defining a second member side wall extending in said transverse direction and two second member retaining flanges each extending laterally inwardly from said second member side wall, said second member having third and fourth longitudinal bends defining two second member retaining lips each extending laterally outwardly from an inward end of each of said second member retaining flanges, each of said second member retaining lips being located between said second member retaining flanges, said second member being located in a mutually opposing relationship to said first member, at least one of said first member and second member side walls having a rib for strengthening and resisting bending;

a third longitudinally extending member having first and second longitudinal bends defining a laterally extending third member base and two third member side walls each extending transversely from said third member base, said third member having third and fourth longitudinal bends defining two third member tabs extending laterally inwardly from said third member side walls;

a fourth longitudinally extending member having first and second longitudinal bends defining a laterally extending fourth member base and two fourth member side walls each extending transversely from said fourth member base, said fourth member having third and fourth longitudinal bends defining two fourth member tabs extending laterally inwardly from said fourth member side walls, said fourth member being located in a mutually opposing relationship to said third member; and said first, second, third, and fourth members being assembled such that said tabs are each gripped by and fit within a retaining channel defined by a pair of said retaining flanges and retaining lips, whereby said first and second members capture and fixedly retain said third and fourth members so that each of said members is mutually affixed in place, thereby defining a first and second T-shaped channel, said T-shaped channels being transversely spaced apart within said dunnage support bar for receiving said dunnage.

8. The dunnage support bar as set forth in claim 7, wherein said bar is formed of spring steel.

9. The dunnage support bar as set forth in claim 8, wherein said steel is heat treated.

10. The dunnage support bar as set forth in claim 7, wherein said bar is formed of a metal having a corrosion-resisting coating.

11. The dunnage support bar as set forth in claim 7, wherein said rib is formed as an inwardly extending indentation.

12. The dunnage support bar as set forth in claim 7, wherein at least one of said bases is formed with a longitudinally extending rib.

13. A dunnage support structure for supporting and retaining dunnage, comprising:

a horizontal frame being affixed to at least two vertically extending support means;

a dunnage support bar supported in place between said at least two vertical support means, said dunnage support bar having a first member extending in a longitudinal direction and having first and second longitudinal bends defining a first base extending in a lateral direction orthogonal to said longitudinal direction and two first side walls each extending from said first base in a transverse direction orthogonal to said longitudinal and lateral directions, said first member having third and fourth bends defining two retaining flanges each extending laterally inwardly from said first side walls, said first member having fifth and sixth bends defining two retaining lips each extending laterally outwardly from said fifth and sixth bends and being located between said retaining flanges and said first base, at least one of said first side walls having a longitudinally extending rib therein for strengthening said first member and resisting bending thereof;

a second longitudinal extending member having first and second longitudinal bends defining a second base and two second side walls each extending from said second base in said transverse direction, said second member having third and fourth longitudinal bends defining two tabs extending laterally inwardly from said second side walls;

said first and second members being assembled such that said tabs each fit within a retaining channel defined by said retaining flanges and retaining lips, whereby said first member fixedly retains said second member in place relative to said first member, thereby defining a T-shaped channel within said dunnage support bar for slidingly receiving said dunnage;

stop means for fixing said dunnage member in place relative to said dunnage bar.

14. The dunnage support structure as set forth in claim 13, wherein said dunnage bar may be removably attached to said at least two vertically extending support means.

15. A dunnage support bar extending in a longitudinal direction for supporting and retaining dunnage, comprising:

a first member having a first base extending in a lateral direction orthogonal to said longitudinal direction, two first sidewalls each extending perpendicular to said first base in a transverse direction orthogonal to said longitudinal and lateral directions, said first sidewalls having a first and a second longitudinal bend so that said first sidewalls define two retaining flanges each extending laterally inwardly from one of said first sidewalls, said retaining flanges having a third and a fourth longitudinal bend defining two retaining lips each extending laterally outwardly from said third and fourth bends respectively, said retaining lips being disposed between said retaining flanges and said first base, at least one of said first sidewalls having a longitudinally extending rib therein for strengthening said first member and resisting bending thereof; and a longitudinally extending insert second member having first and second longitudinal bends defining a second base and two second sidewalls each extending from said second base in said transverse direction, said second member having third and fourth longitudinal bends defining two tabs extending laterally inwardly from said second side walls;

said dunnage bar being assembled such that said tabs each fit within a retaining channel defined between said retaining flanges and retaining lips, whereby said retaining channels fixedly secure said insert member in place relative thereto, thereby defining a T-shaped channel within said dunnage support bar for receiving said dunnage.

* * * * *